United States Patent [19]

Konno

[11] Patent Number: 4,848,285

[45] Date of Patent: Jul. 18, 1989

[54] VALVE OPERATING APPARATUS FOR AN INTERNAL COMBUSTION ENGINE

[75] Inventor: Tsuneo Konno, Saitama, Japan

[73] Assignee: Honda Giken Kogyo Kabushiki Kaisha, Tokyo, Japan

[21] Appl. No.: 107,978

[22] Filed: Oct. 14, 1987

[30] Foreign Application Priority Data

Oct. 15, 1986 [JP] Japan ..... 61-245065

[51] Int. Cl.[4] ..... F01L 1/18

[52] U.S. Cl. ..... 123/90.16; 123/90.44

[58] Field of Search ..... 123/90.16, 90.17, 90.27, 123/90.44, 90.4, 90.39, 90.48; 74/569

[56] References Cited

U.S. PATENT DOCUMENTS

| | | | |
|---|---|---|---|
| 189,223 | 4/1877 | Houghtaling et al. | 74/569 |
| 2,829,540 | 4/1958 | Niemeyer | 74/569 |
| 3,040,506 | 6/1962 | Lindsay | 74/569 |
| 3,299,869 | 1/1967 | Sicklesteel | 123/90.27 |
| 3,610,218 | 10/1971 | Durham | 123/90.44 |
| 3,722,484 | 3/1973 | Gordini | 123/90.27 |
| 4,151,817 | 5/1979 | Mueller | 123/90.16 |
| 4,203,397 | 5/1980 | Soeters, Jr. | 123/90.16 |
| 4,206,734 | 6/1980 | Perr et al. | 123/502 |
| 4,448,156 | 5/1984 | Henault | 123/90.17 |
| 4,499,870 | 2/1985 | Aoyama | 123/198 F |
| 4,523,550 | 6/1985 | Matsuura | 123/90.16 |
| 4,534,323 | 8/1985 | Kato et al. | 123/90.16 |
| 4,535,732 | 8/1985 | Nakano et al. | 123/90.16 |
| 4,537,164 | 8/1985 | Ajiki et al. | 123/90.16 |
| 4,537,165 | 8/1985 | Honda et al. | 123/90.16 |
| 4,545,342 | 10/1985 | Nakano et al. | 123/198 F |
| 4,567,861 | 2/1986 | Hara et al. | 123/90.16 |
| 4,576,128 | 3/1986 | Kenichi | 123/198 F |
| 4,584,974 | 4/1986 | Aoyama et al. | 123/90.16 |
| 4,589,387 | 5/1986 | Miura et al. | 123/198 F |
| 4,612,884 | 9/1986 | Ajiki et al. | 123/90.16 |
| 4,615,307 | 10/1986 | Kodama et al. | 123/90.16 |
| 4,628,874 | 12/1986 | Barlow | 123/90.27 |
| 4,656,977 | 4/1987 | Nagahiro et al. | 123/90.16 |
| 4,690,110 | 9/1987 | Nishimura et al. | 123/90.17 |
| 4,727,831 | 3/1988 | Nagahiro et al. | 123/90.16 |

FOREIGN PATENT DOCUMENTS

| | | |
|---|---|---|
| 0186341 | 7/1986 | European Pat. Off. . |
| 0213758 | 3/1987 | European Pat. Off. . |
| 3613945 | 10/1986 | Fed. Rep. of Germany . |
| 1003568 | 3/1952 | France . |
| 61-19911 | 1/1986 | Japan . |
| 61-81510 | 4/1986 | Japan . |
| 511903 | 8/1939 | United Kingdom . |
| 1399813 | 7/1975 | United Kingdom . |
| 2054036 | 2/1981 | United Kingdom . |
| 2066361 | 7/1981 | United Kingdom . |
| 2141172 | 12/1984 | United Kingdom . |
| 2159877 | 12/1985 | United Kingdom . |
| 2185784 | 7/1987 | United Kingdom . |

*Primary Examiner*—Andrew M. Dolinar
*Attorney, Agent, or Firm*—Lyon & Lyon

[57] ABSTRACT

Valve operating apparatus for an internal combustion engine is described in which the cam follower surface on the valve operating rocker arms is defined by the external surface of a cylindrical body mounted for rotation on the rocker arm, whereby the cam follower surface is in rolling contact with the associated cam to reduce friction losses in the apparatus and wear of the apparatus components.

4 Claims, 2 Drawing Sheets

VALVE OPERATING APPARATUS FOR AN INTERNAL COMBUSTION ENGINE

BACKGROUND OF THE INVENTION

The present invention relates to a valve operating apparatus for an internal combustion engine. More particularly, the invention involves a valve operating apparatus in which the intake or exhaust valves are operated by pivotally mounted, cam-driven rocker arms having a selective coupling operative between the rocker arms to open and close the valves in response to a camshaft rotated in synchronism with the operation of the engine.

Valve operating apparatus of the described type are disclosed, for example, in U.S. Pat. No. 4,545,342, granted Oct. 8, 1985 to Y. Nakano et al.,and assigned to the assignee herein. In such valve operating apparatus the cam follower is held in direct sliding contact with the rotating cam. Where the cam follower is in direct sliding contact with the cam, however, friction losses in the system are significantly great, as is the amount of wear in the respective cam and cam follower surfaces.

There has been proposed, as disclosed in Japanese Laid-Open Patent Publication No. 61-19912, a device in which a rotating body held in sliding contact with a cam is rotatably supported on a piston of a selective coupling. While such a rotating body can be disposed in a certain rocker arm according to this prior art, however, it would be difficult in a layout to provide rotating bodies in all rocker arms since the pistons are moved.

It is to the amelioration of this problem that the present invention is directed.

SUMMARY OF THE INVENTION

According to the present invention there is provided a valve operating apparatus in which a selective coupling comprises pistons movable between positions in which the pistons interconnect adjacent cam followers and positions in which they disconnect the adjacent cam followers. The cam followers fixedly mount cylindrical shaft members for guiding the movement of the pistons and cylindrical bodies are rotatably supported on the shaft members to engage in rolling contact the cams mounted on a rotating camshaft.

Inasmuch as each cam follower is held in contact with its associated cam through the rotating body, the friction losses are reduced by the rolling contact between the respective members, as is the amount of wear to which the respective members are subjected. The relative positional accuracy of the piston in each selective coupling is increased since the rotating body is supported on the shaft member which is fixedly mounted in the cam follower for guiding movement of the piston.

It is accordingly an object of the present invention to provide a valve operating device for an internal combustion engine which can readily reduce friction losses and the amount of wear in the cam followers of the valve operating system.

For a better understanding of the invention, its operating advantages and the specific objectives obtained by its use, reference should be made to the accompanying drawings and description which relate to a preferred embodiment thereof.

DESCRIPTION OF THE PREFERRED EMBODIMENTS OF THE INVENTION

Figure 1:
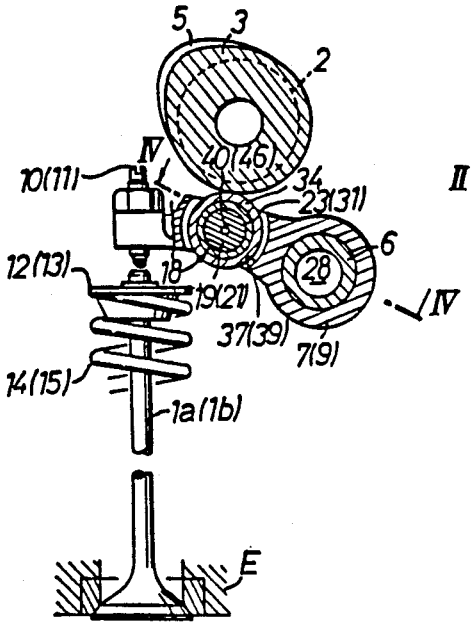
FIG. 1 is a plan view of a valve operating apparatus incorporating the present invention.
Figure 2:
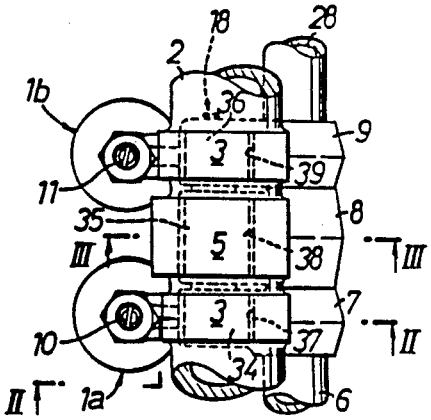
FIG. 2 is an elevational sectional view taken along line II—II of FIG. 1.

FIGS. 1 and 2 illustrate a pair of intake valves 1*a*, 1*b* disposed in an engine body E to be opened and closed by low-speed cams 3, 3 and a high-speed cam 5 integrally formed on a camshaft 2, and first, second, and third rocker arms 7, 8, 9 angularly movably supported as cam followers on a rocker shaft 6 parallel to the camshaft 2. The camshaft 2 is rotatable in synchronism with rotation of the engine at a speed ratio of ½ with respect to the speed of rotation of the engine. The intake valves 1*a*, 1*b* are selectively operated in a mode in which both intake valves 1*a*, 1*b* are opened and closed at the valve timing and lift according to the cam profile of the low-speed cams 3, 3 and another mode in which both intake valves 1*a*, 1*b* are opened and closed at the valve timing and lift according to the cam profile of the high-speed cam 5.

The camshaft 2 is rotatably disposed above the engine body 3. The low-speed cams 3, 3 are integrally formed with the camshaft 2 in alignment with the intake valves 1*a*, 1*b*, respectively.

The rocker shaft 6 is fixed below the camshaft 2. The first rocker arm 7, corresponding to the intake valve 1*a*, and the third rocker arm 9, corresponding to the intake valve 1*b*, have base portions swingably supported on the rocker shaft 6 and extend to positions above the intake valves 1*a*, 1*b*, respectively. Tappet screws 10, 11 are threaded through the distal ends of the rocker arms 7, 9, respectively, and are engageable, respectively, with the upper ends of the intake valves 1*a*, 1*b*.

Flanges 12, 13 are attached to the upper ends of the intake valves 1*a*, 1*b*. The intake valves 1*a*, 1*b* are normally urged in a closing direction by valve springs 14, 15 disposed between the flanges 12, 13 and the engine body E.

Figure 3:
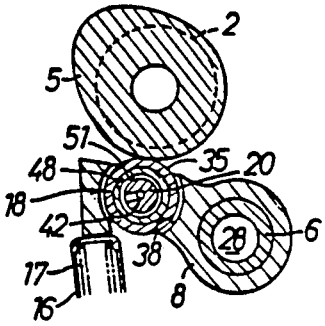
FIG. 3 is an elevational sectional view taken along line III—III of FIG. 1.

As shown in FIG. 3, the second rocker arm 8 has a base portion swingably supported on the rocker shaft 6 between the first and third rocker arms 7, 9. The second rocker arm 8 extends slightly from its base portion toward the intake valves 1*a*, 1*b*. A cylindrical lifter 16, having a closed upper end and a lower end opening downwardly, is held against the lower surface of the distal end of the second rocker arm 8. A lifter spring 17 is interposed between the lifter 15 and the engine body for normally urging the lifter 16 upwardly.

Figure 4:
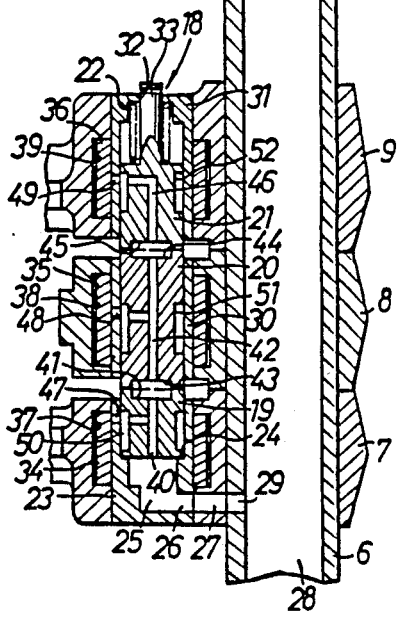
FIG. 4 is a sectional view taken along lines IV—IV of FIG. 2.

With reference to FIG. 4, a selective coupling 18 is disposed in the rocker arms 7 through 9 below the camshaft 2 for selectively interconnecting and disconnecting the rocker arms. The selective coupling 18 comprises a first piston 19 for selectively interconnecting and disconnecting the first and second rocker arms 7, 8, a second piston 20 for selectively interconnecting and disconnecting the second and third rocker arms 8, 9. Also provided are a stopper 21 for limiting movement of the pistons 19, 20, and a return spring 22 for urging the pistons 19, 20 in a direction to disconnect the rocker arms.

A first cylindrical shaft member 23 having a closed outer end is fitted and secured in the first rocker arm 7 parallel to the rocker shaft 6. The first shaft member 23 is disposed below the camshaft 2 and has its inner end opening toward the second rocker arm 8. The first piston 19 is slidably fitted in the first shaft member 23. The first piston 19 and the closed end of the first shaft member 23 jointly define a hydraulic pressure chamber 25 therebetween. The first shaft member 23 has on its interior surface a step 24 facing toward the second rocker arm 8 which limits movement of the first piston 19 toward the hydraulic pressure chamber 25. The first rocker arm 7 has a hydraulic passage 27 communicating with the hydraulic pressure chamber 25 through a hydraulic passage 26 defined in the first shaft member 23.

The rocker shaft 6 has a hydraulic pressure supply passage 28 communicating with a hydraulic pressure supply source (not shown). The hydraulic pressure supply passage 28 is held in communication with the hydraulic passage 27 through a hole 29 defined in a side wall of the rocker shaft 6, irrespective of how the first rocker arm 7 is angularly positioned.

A second cylindrical shaft member 30 corresponding to the first shaft member 23, but being open at both opposite ends, is fitted and secured in the second rocker arm 8 parallel to the rocker shaft 6. A second piston 20 is slidably fitted in the second shaft member 30.

A third cylindrical shaft member 31 having a closed outer end is fitted and secured in the third rocker arm 9 parallel to the rocker shaft 6. The third shaft member 31 has an inner end opening toward the second rocker arm 8. The stopper 21 is slidably fitted in the third shaft member 31. A through-hole 32 is defined in the closed end of the third shaft member 31 and a shaft 33, coaxially joined to the stopper 21, is movably inserted in the through-hole 32. A return spring 22 is disposed around the shaft 33 between the stopper 21 and the closed end of the third shaft member 31 to resiliently bias the stopper to push the first and second pistons 19, 20 toward the hydraulic pressure chamber 25.

The first piston 19, the second piston 20, and the stopper 21 are held in laterally adjacent, mutually sliding contact. When no hydraulic pressure is applied to the hydraulic pressure chamber 25, the first piston 19 is held against the step 24. In this position, the lateral, slidingly contacting surfaces of the first and second pistons 19, 20 are positioned between the first and second rocker arms 7, 8 and the lateral, slidingly contacting surfaces of the second piston 20 and the stopper 21 are positioned between the second and third rocker arms 8, 9. Therefore, the rocker arms 7 through 9 are disconnected and relatively angularly movable. When hydraulic pressure is supplied to the hydraulic pressure chamber 25, the first piston 19 pushes the second piston 20 and the stopper 21 against the spring force of the return spring 22 causing the first piston 19 to extend partly into the second shaft member 30 and also causing the second piston 20 to partly extend into the third shaft member 31. The first through third rocker arms 7 through 9 are thus mutually interconnected for movement in unison with each other.

In the described arrangement, cylindrical rotating bodies 34, 35, 36 are held in rolling contact with the corresponding cams 3, 5. These bodies are rotatably supported respectively on intermediate portions of the first through third shaft members 23, 30, 31. The rocker arms 7 through 9 have respective recesses 37, 38, 39 defining clearance spaces in which the rotating bodies 34, 35, 36 are disposed. The shaft members 23, 30, 31 are inserted through the rotating bodies 34, 35, 36 which are disposed in the recesses 37, 38, 39, and are fitted and secured in the respective rocker arms 7 through 9. The rotating bodies 34 through 36 are thus rotatably supported on the respective shaft members 23, 30, 31.

The first piston 19 has a coaxial hydraulic passage 40 having one end communicating with the hydraulic pressure chamber 25 and opening into a cavity 41 defined in the lateral surface of the first piston 19 which slidingly contacts the second piston 20. The second piston 20 has a coaxial hydraulic passage 42 having one end opening into a cavity 43 defined in the lateral surface of the second piston 20, which slidingly contacts the first piston 19, and an opposite end opening into a cavity 44 defined in the lateral surface of the second piston 20 which slidingly contacts the stopper 21. The stopper 21 has a hydraulic passage 46 having one end opening into a cavity 45 defined in its lateral surface that slidingly contacts the second piston 20.

The cavities 41, 43 are cooperatively shaped such that they allow communication between the hydraulic passages 40, 42 at all times, even when the first and second pistons 19, 20 are axially displaced. The cavities 44, 46 are similarly shaped such that they allow communication between the hydraulic passages 42, 46 at all times, even when the second piston 20 and the stopper 21 are axially displaced. Therefore, the hydraulic passages 40, 42, 46 are maintained in communication with each other and also with the hydraulic pressure chamber 25 at all times.

The shaft members 23, 30, 31 have supply passages 47, 48, 49 defined in their respective side walls for supplying an amount of operating fluid between the shaft members 23, 30, 31 and the rotating bodies 34 through 36 for lubrication purposes. The first piston 19, the second piston 20, and the stopper 21 have respective annular grooves 50, 51, 52 by which the hydraulic passages 40, 42, 44 are maintained in communication with the respective supply passages 47 through 49 irrespective of how the pistons 19, 20 and the stopper 21 are positioned. Therefore, lubricating oil is supplied from the hydraulic pressure chamber 25 between the shaft members 23, 30, 31 and the rotating bodies 34 through 36.

The operation of the described arrangement is as follows. During low-speed operation of the engine, no hydraulic pressure is supplied to the hydraulic pressure chamber 25 of the selective coupling 18. The slidingly contacting surfaces of the first and second pistons 19, 20 are positioned between the first and second rocker arms 7, 8, and the slidingly contacting surfaces of the second pistons 20 and the stopper 21 are positioned between the second and third rocker arms 8, 9. The rocker arms 7 through 9 are thus disconnected from each other. With the rocker arms thus disconnected, the first and third rocker arms 7, 9 are angularly moved by the low-speed cams 3, 3, and hence the intake valves 1*a*, 1*b* are opened and closed at the valve timing and lift according to the cam profile of the low-speed cams 3. At this time, the rotating bodies 34, 36 are held in rolling contact with the respective low-speed cams 3, 3 for swinging the first and third rocker arms 7, 9. Therefore, heat which would otherwise be generated by sliding contact between the cams 3, 3 and the first and third rocker arms 7, 9 is eliminated. Consequently, the thickness of a lubricating oil layer between the members is prevented from being reduced. As a result, wear resistance of the members is increased and frictional losses are lowered.

During high-speed operation of the engine, hydraulic pressure is supplied to the hydraulic pressure chamber 25. The first piston 19 pushes the second piston 20 and the stopper 21 against the bias of the return spring 22, thereby interconnecting the rocker arms 7 through 9. Under this condition, since the amount of swinging movement of the second rocker arm 8 driven by the high-speed cam 5 is greatest due to the greater radius of the lobe on the cam 5, the first and third rocker arms 7, 9 are caused to swing with the second rocker arm 8, thereby enabling the intake valves 1*a*, 1*b* to be opened and closed at the valve timing and lift according to the cam profile of the high-speed cam 5.

While the engine is in such high-speed operation, the rotating body 35 is held in rolling contact with the high-speed cam 5, thus reducing the friction loss between the high-speed cam 5 and the rotating body 35 and also wear on the high-speed cam 5.

By axially aligning the first piston 19, the second piston 20, the stopper 21, and the rotating bodies 34 through 36, an increase in the weight resulting from the addition of the rotating bodies 34 through 36 can be reduced. The relative positional accuracy of the first piston 19, the second piston 20, and the stopper 21 in the selective coupling 18 can easily be increased and kept as desired since it is determined by the distances between the centers of the rotating bodies 34 through 36 and the center of the rocker shaft 6, and the inside and outside diameters of the rotating bodies 34 through 36.

Figure 5:
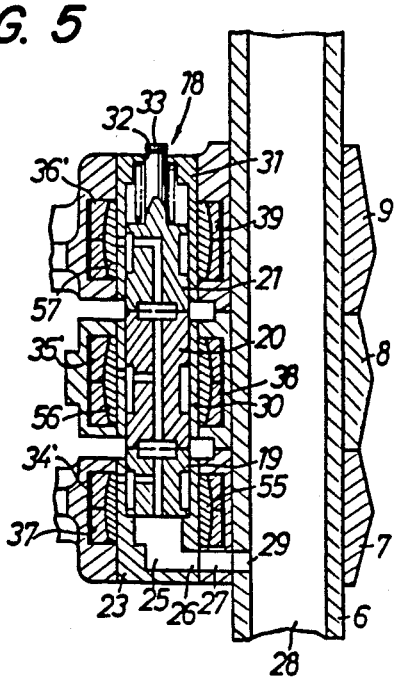
FIG. 5 is a view similar to FIG. 4 illustrating another embodiment of the invention.

FIG. 5 shows another embodiment of the present invention. In this embodiment, spherical bushings 55, 56, 57 are fitted over the respective shaft members 23, 30, 31. Rotating bodies 34', 35', 36', each composed of mutually engaging, axially split members are supported by the respective spherical bushings 55 through 57 on the shaft members 23, 30, 31. With this arrangement, the rotating bodies 34' through 36' are prevented from localized engagement with the cams 3, 5.

While the present invention has been described as being incorporated in rocker arms operated by the described cams, the present invention is also applicable to a valve operating device in which a circular raised portion is disposed in a camshaft for disabling one or all of the intake valves. The number of intake valves and the number of cam followers are not limited to those of the illustrated embodiments. Moreover, the present invention can be embodied equally as well in a device for operating exhaust valves.

It will be appreciated that, by means of practice of the described embodiments of the invention, friction losses in the cam followers, as well as wear on the cams or raised portions and on the rotating bodies is reduced. In addition, the relative positional accuracy of the pistons is increased.

Although certain preferred embodiments of the invention have been shown and described it should be understood that various changes can be made therein without departing from the scope of the appended claims.

I claim:

1. Valve operating apparatus for an internal combustion engine having a plurality of valves operable in each engine cylinder, comprising:

a plurality of pivotally mounted rocker arms disposed in adjacent relation for operating at least one of said valves;

coupling means carried by said rocker arms for selective mutual connection or disconnection thereof, said coupling means including a hollow cylindrical shaft fixedly disposed in each said rocker arm and selectively actuated piston means movable in each said cylindrical shaft;

a generally cylindrical body rotatably mounted on each said cylindrical shaft having an external surface defining the follower surface of said rocker arm; and a plurality of cams mounted for rotation on a camshaft driven in synchronism with the operation of said engine, each of said cams being arranged to engage the follower surface of each said rocker arms.

2. The valve operating apparatus according to claim 1 including a spherical busing on each said shaft for rotatably mounting said rotatable body.

3. The valve operating apparatus according to claim 2 in which each said rotatable body is formed by axially separate members; and means for maintaining said members in mutual axial bearing engagement.

4. The valve operating apparatus according to claim 3 in which said rocker arms contain a recess having a generally cylindrical surface in closely spaced, concentric relation to said body for maintaining said members in axial bearing engagement.

* * * * *